US010385819B2

(12) United States Patent
Marrs et al.

(10) Patent No.: US 10,385,819 B2
(45) Date of Patent: Aug. 20, 2019

(54) MULTI-STRIKE IGNITION SYSTEM FOR AN INTERNAL COMBUSTION ENGINE

(71) Applicant: MARSHALL ELECTRIC CORP., Rochester, IN (US)

(72) Inventors: Thomas C. Marrs, Rochester, IN (US); Stephen P. Barlow, Carmel, IN (US)

(73) Assignee: MARSHALL ELECTRIC CORP., Rochester, IN (US)

( * ) Notice: Subject to any disclaimer, the term of this patent is extended or adjusted under 35 U.S.C. 154(b) by 125 days.

(21) Appl. No.: 15/796,339

(22) Filed: Oct. 27, 2017

(65) Prior Publication Data

US 2019/0128232 A1 May 2, 2019

(51) Int. Cl.

| | |
|---|---|
| ***F02P 5/145*** | (2006.01) |
| ***F02P 15/08*** | (2006.01) |
| ***F02P 3/00*** | (2006.01) |
| ***H01T 15/00*** | (2006.01) |
| *F02P 3/08* | (2006.01) |
| *F02P 15/02* | (2006.01) |

(52) U.S. Cl.

CPC ..... *F02P 5/145* (2013.01); *F02P 3/005* (2013.01); *F02P 15/08* (2013.01); *H01T 15/00* (2013.01); *F02P 3/08* (2013.01); *F02P 15/02* (2013.01)

(58) Field of Classification Search

CPC .. F02P 5/145; F02P 15/08; F02P 15/02; F02P 15/10; F02P 3/005; F02P 3/08; F02P 3/0884; F02P 3/01; F02P 3/0456; F02P 9/007; F02P 9/002

See application file for complete search history.

(56) References Cited

U.S. PATENT DOCUMENTS

| | | | | |
|---|---|---|---|---|
| 4,149,508 | A * | 4/1979 | Kirk, Jr. | F02P 3/0435 123/598 |
| 4,998,526 | A | 3/1991 | Gokhae | |
| 5,806,504 | A | 9/1998 | French et al. | |
| 6,135,099 | A | 10/2000 | Marrs | |
| 2009/0126710 | A1 * | 5/2009 | Alger, II | F02P 3/04 123/636 |
| 2010/0307468 | A1 * | 12/2010 | Puettmann | F02P 3/0414 123/636 |
| 2015/0300312 | A1 * | 10/2015 | Ferguson | F02P 5/15 123/406.12 |
| 2016/0084213 | A1 * | 3/2016 | Nakayama | F02P 3/0442 123/634 |

* cited by examiner

*Primary Examiner* — George C Jin
(74) *Attorney, Agent, or Firm* — Egbert Law Offices, PLLC

(57) ABSTRACT

An ignition system for an internal combustion engine has a power source, a transformer having a first primary winding and a second primary winding and a secondary winding, a connector extending from the secondary winding so as to connect with a terminal of a spark plug, and a multi-strike circuit cooperative with the electronic spark timing circuit so as to fire the transformer with multiple strikes between the falling edge and the rising edge. A booster circuit is cooperative at the electronic spark timing circuit so as to collect and store energy from the power source while the electronic spark timing circuit fires the transformer. A delay circuit fires the transformer at a time subsequent to the falling edge and before the rising edge.

11 Claims, 3 Drawing Sheets

MULTI-STRIKE IGNITION SYSTEM FOR AN INTERNAL COMBUSTION ENGINE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to internal combustion engines. More particularly, the present invention relates to electrical ignition apparatus that are used for the igniting of fuel within the internal combustion engine. The present invention also relates to ignition coils that apply an AC voltage for the ignition of the spark plug. Furthermore, the present invention relates to ignition systems that produce multiple strikes, provide for power boost, and provide for a delay.

2. Description of Related Art Including Information Disclosed Under 37 CFR 1.97 and 37 CFR 1.98

Most internal combustion engines have some type of an ignition circuit to generate a spark in the cylinder. The spark causes combustion of the fuel in the cylinder to drive the piston and the attached crankshaft. Typically, the engine includes a plurality of permanent mount magnets mounted on the flywheel of the engine and a charge coil mounted on the engine housing in the vicinity of the flywheel. As the flywheel rotates, the magnets pass the charge coil. A voltage is thereby generated on the charge coil and this voltage is used to charge a high-voltage capacitor. The high-voltage charge on the capacitor is released to the ignition coil by way of a triggering circuit so as to cause a high-voltage, short-duration electrical spark across the spark gap of the spark plug and ignite the fuel in the cylinder. This type of ignition is called a capacitive discharge ignition.

The design of standard reciprocating internal combustion engines which use ignition coils to initiate combustion have, for years, utilized combustion chamber shapes and spark plug placements which were heavily influenced by the need to reliably initiate combustion using only a single short-duration spark having a relatively low intensity. In recent years, however, increased emphasis has been placed on fuel efficiency, completeness of combustion, exhaust cleanliness, and reduced variability in cycle-to-cycle combustion. This emphasis has meant that the shape of the combustion chamber must be modified and the ratio of the fuel-air mixture changed. In some cases, a procedure has been used which deliberately introduces strong turbulence or a rotary flow of the fuel-air mixture at the area where the spark plug electrodes are placed. This often causes an interruption or "blowing out" of the arc. This has placed increasing demands on the effectiveness of the combustion initiation process. It is been found highly preferable, in such applications, to have available an arc which may be sustained for as much as four to five milliseconds. Efforts to effectuate this idea have resulted in various innovations identified in several patents.

For example, U.S. Pat. No. 5,806,504, issued on Sep. 15, 1998 to French et al., teaches an ignition circuit for an internal combustion engine in which the ignition circuit includes a transformer having a secondary winding for generating a spark and having first and second primary windings. A capacitor is connected to the first primary winding to provide a high-energy capacitive discharge voltage to the transformer. A voltage regulator is connected to the secondary primary winding for generating an alternating current voltage. A control circuit is connected to the capacitor and to the voltage generator for providing control signals to discharge the high-energy capacitive discharge voltage to the first primary winding and for providing control signals to the voltage generator so as to generate an alternating current voltage.

U.S. Pat. No. 4,998,526, issued on Mar. 12, 1991 to K. P. Gokhae, teaches an alternating current ignition system. The system applies alternating current to the electrodes of a spark plug to maintain an arc at the electrodes for a desired period of time. The amplitude of the arc current can be varied. The alternating current is developed by a DC-to-AC inverter that includes a transformer that has a center-primary and a secondary that is connected to the spark plug. An arc is initiated at the spark plug by discharging a capacitor to one of the winding portions at the center-primary. Alternatively, the energy stored in an inductor may be supplied to a primary winding portion to initiate an arc. The ignition system is powered by a controlled current source that receives input power from a source of direct voltage, such as a battery on the motor vehicle.

In each of these prior art patents, the devices used dual mechanisms in which a high-energy discharges were supplemented with a low-energy extending mechanism. The method of extending the arc, however, presents problems to the end-user. First, the mechanism is, by nature, electronically complex in that multiple control mechanisms must be present either in the form of two separate arc mechanisms. Secondly, no method is presented for automatically sustaining the arc under a condition of repeated interruptions. Additionally, these mechanisms do not necessarily provide for a single functional-block unit of low mass and small size which contains all of the necessary functions within.

U.S. Pat. No. 6,135,099, issued on Oct. 24, 2000 to T. Marrs, discloses an ignition system for an internal combustion engine that comprises a transformer means having a primary winding adapted to be connected to a power supply and having a secondary winding adapted be connected to a spark plug. The transformer serves to produce an output from the secondary winding having a frequency of between 1 kHz and 100 kHz and a voltage of at least 20 kV. A controller is connected to the transformer so as to activate and deactivate the output of the transformer means relative to the combustion cycle. The transformer serves to produce the output having an alternating current with a high-voltage sine wave reaching at least 20 kV. A voltage regulator is connected to the power supply into the transformer so as to provide a constant DC voltage input to the transformer. The transformer produces power of constant wattage from the output of the secondary winding during the activation by the controller. The controller is connected to the transformer so as to allow the transformer to produce an arc of controllable duration across the electrode of the spark plug. This duration can be between 0.5 milliseconds and 4 milliseconds. A battery is connected the primary winding of the transformer. The battery produces a variable voltage of between 5 and 15 volts.

Typically, the engine control module provides an electronic spark timing pulse which is used to command a given spark event for a given engine cylinder. This electronic spark timing pulse is commanded for a given amount of time to charge the primary coil to the desired current or energy. The electronic spark timing pulse duration is often referred to as "dwell-time" or charging time for a given coil and engine operating condition. As an example, during cold starting conditions, when the engine is cold, and the battery voltage is low, the electronic spark timing control signal for a given cylinder may have an extended pulse duration to fully charge the coil to generate the necessary energy in the primary coil. This energy is then transferred to the secondary coil that is connected to the spark plug output. Likewise, during hot engine conditions and nominal battery power, the electronic spark timing pulse can be commanded to have a shorter duration to fully charge the primary coil to a given energy level. Thus, a given electronic spark timing pulse for commanding a given coil operation will vary the dwell time, or charging time, depending on several engine sensor inputs and desired engine operating conditions. Typically, current ignition systems use the electronic spark timing pulse to command a semiconductor power switch device which is connected to the primary coil and allows the coil to reach a targeted primary current. When the semiconductor power device is switched off, the stored energy in the primary coil is then transferred to the secondary coil. Based on the clamping voltage of the power semiconductor switch, and the turns ratio of the primary to secondary windings, an available voltage of approximately 40,000 volts can be provided to the spark plug output. Therefore, the high-voltage spark event is commanded by the falling edge of an electronic spark timing pulse. This translates to a command "turn-off" of the semiconductor power device and energy is then transferred to the spark plug with an exponential voltage decay. Typically, one spark event occurs for each electronic spark timing cycle for a given engine cylinder. This method of control has been employed by numerous engine control module designs used to command DC ignition systems for many years and has become the general method of firing a given spark plug used in an internal combustion engine.

The design of standard reciprocating internal combustion engines which use spark plugs and induction coils to initiate combustion have, for years, utilized combustion chamber shapes and spark plug placements which are heavily influenced by the need to reliably initiate combustion using a single short-duration spark of relatively low intensity that is timed to fire off of the falling edge of the given electronic spark timing pulse.

In recent years, however, increased emphasis has been placed on fuel efficiency, completeness of combustion, exhaust cleanliness, and reduced variability in cycle-to-cycle combustion. This emphasis has meant that the shape of the combustion chamber must be modified and the ratio of the fuel-air mixture changed. In some cases, a procedure has been used which deliberately introduces strong turbulence or a rotary flow to the fuel-air mixture at the area where the spark plug electrodes are placed. This often causes an interruption or blowing out of the arc. This places increasing demands on the effectiveness of the combustion initiation process.

In the past, various patents have issued with respect to such ignition systems. For example, U.S. Pat. No. 5,806,504, issued on Sep. 15, 1998 to French et al., teaches an ignition circuit for an internal combustion engine in which the ignition circuit includes a transformer having a secondary winding for generating a spark and having first and second primary windings. A capacitor is connected to the first primary winding to provide a high-energy capacitive discharge voltage to the transformer. A voltage regulator is connected to the secondary primary winding for generating an alternating current voltage. A control circuit is connected to the capacitor and to the voltage generator for providing control signals to discharge the high-energy capacitive discharge voltage to the first primary winding and for providing control signals to the voltage generator so as to generate an alternating current voltage.

U.S. Pat. No. 4,998,526, issued on Mar. 12, 1991 to K. P. Gokhae, teaches an alternating current ignition system. The system applies alternating current to the electrodes of a spark plug to maintain an arc at the electrodes for a desired period of time. The amplitude of the arc current can be varied. The alternating current is developed by a DC-to-AC inverter that includes a transformer that has a center-primary and a secondary that is connected to the spark plug. An arc is initiated at the spark plug by discharging a capacitor to one of the winding portions at the center-primary. Alternatively, the energy stored in an inductor may be supplied to a primary winding portion to initiate an arc. The ignition system is powered by a controlled current source that receives input power from a source of direct voltage, such as a battery on the motor vehicle.

In each of these prior art patents, the devices used dual mechanisms in which a high-energy discharges were supplemented with a low-energy extending mechanism. The method of extending the arc, however, presents problems to the end-user. First, the mechanism is, by nature, electronically complex in that multiple control mechanisms must be present either in the form of two separate arc mechanisms. Secondly, no method is presented for automatically sustaining the arc under a condition of repeated interruptions. Additionally, these mechanisms do not necessarily provide for a single functional-block unit of low mass and small size which contains all of the necessary functions within.

U.S. Pat. No. 6,135,099, issued on Oct. 24, 2000 to T. Marrs, discloses an ignition system for an internal combustion engine that comprises a transformer means having a primary winding adapted to be connected to a power supply and having a secondary winding adapted be connected to a spark plug. The transformer serves to produce an output from the secondary winding having a frequency of between 1 kHz and 100 kHz and a voltage of at least 20 kV. A controller is connected to the transformer so as to activate and deactivate the output of the transformer means relative to the combustion cycle. The transformer serves to produce the output having an alternating current with a high-voltage sine wave reaching at least 20 kV. A voltage regulator is connected to the power supply into the transformer so as to provide a constant DC voltage input to the transformer. The transformer produces power of constant wattage from the output of the secondary winding during the activation by the controller. The controller is connected to the transformer so as to allow the transformer to produce an arc of controllable duration across the electrode of the spark plug. This duration can be between 0.5 milliseconds and 4 milliseconds. A battery is connected the primary winding of the transformer. The battery produces a variable voltage of between 5 and 15 volts.

It is an object of the present invention to provide an ignition system that produces a spark arc of a controllable duration.

It is another object of the present invention to provide an ignition system that allows various spark arc patterns across the electrode of the spark plug.

It is another object of the present invention to provide an ignition system that can produce multiple strikes during the firing of the spark plug.

It is another object of the present invention to provide an ignition system that allows for consistent charging regardless of the condition of the battery.

It is still another object of the present invention to provide an ignition system that can delay the firing of the spark plug for a desired period of time.

It is another object of the present invention to provide an ignition system that promotes fuel efficiency.

It is another object of the present invention to provide an ignition system that provides complete combustion exhaust cleanliness.

It is still another object of the present invention to provide an ignition system which allows for the use of very small ignition coils.

It is still a further object of the present invention to provide an ignition system that provides the ability to pulse the spark arc.

These and other objects and advantages of the present invention will become apparent from a reading of the attached specification and appended claims.

BRIEF SUMMARY OF THE INVENTION

The present invention is an ignition system for an internal combustion engine. The ignition system comprises a power source, a transformer having a first primary winding and a second primary winding and a secondary winding, a connector extending from the secondary winding and adapted to connect with a terminal of a spark plug of the internal combustion engine, an electronic spark timing circuit cooperative at the transformer so as to activate and deactivate a voltage to the first and second primary windings. The first and second primary windings are connected to the power source such that the transformer produces an alternating voltage output from the secondary winding of between 1 kHz and 100 kHz and a voltage of at least 20 volts. The electronic spark timing circuit produces a square wave of voltage in which the square wave has a rising edge and a falling edge. The electronic spark timing circuit fires the transformer at or subsequent to the falling edge and before the rising edge. A multi-strike circuit is cooperative at the electronic spark timing circuit so as to fire the transformer with multiple strikes between the falling edge and the rising edge.

In the present invention, the multi-strike circuit has an oscillator which fires the transformer with multiple strikes in which each strike has a duration of between one and two milliseconds. The square wave can have a rising edge from 0 volts to 5 volts and a falling edge of 5 volts to 0 volts.

The ignition system further includes a gate-driver IC cooperative with the electronic spark timing circuit so as to transmit voltage relative to a timing pulse of the electronic spark timing circuit. A first field effect transistor is connected to an output of the gate-driver IC. The first field effect transistor is switchable so as to transmit the alternating voltage to the first primary winding. A second field effect transistor is connected to an output of the gate-driver IC. The second field effect transistor is switchable so as to transmit the alternating voltage to the secondary winding. The gate driver IC inverts voltage so as to cause the first field effect transistor and the second field effect transistor to bias alternately. The square wave of voltage has a duration of between ten and fifteen milliseconds between the falling edge and the rising edge.

A booster circuit is cooperative with the electronic spark timing circuit so as to collect and store energy from the power source while the electronic spark timing circuit fires the transformer. The booster circuit has a capacitor connected to the power source. The capacitor stores and discharges at least 20 volts. The booster circuit also has an inductor cooperative with the capacitor so as to store energy from the power source and to pass power to the capacitor. The booster circuit has a field-effect transistor controlling the flow of the energy from the inductor to the capacitor.

A delay circuit is cooperative with the electronic spark timing circuit so as to fire the transformer at a time subsequent to the falling edge of the square wave and before the rising edge. This delay circuit includes a NOR gate logic circuit.

This foregoing Section is intended to describe, with particularity, the preferred embodiments of the present invention. It is understood that variations to these preferred embodiments can be made within the scope of the present claims. As such, this Section should not be construed, in any way, as limiting of the broad scope of the present invention. The present invention should only be limited by the following claims and their legal equivalents.

DETAILED DESCRIPTION OF THE INVENTION

Figure 1:
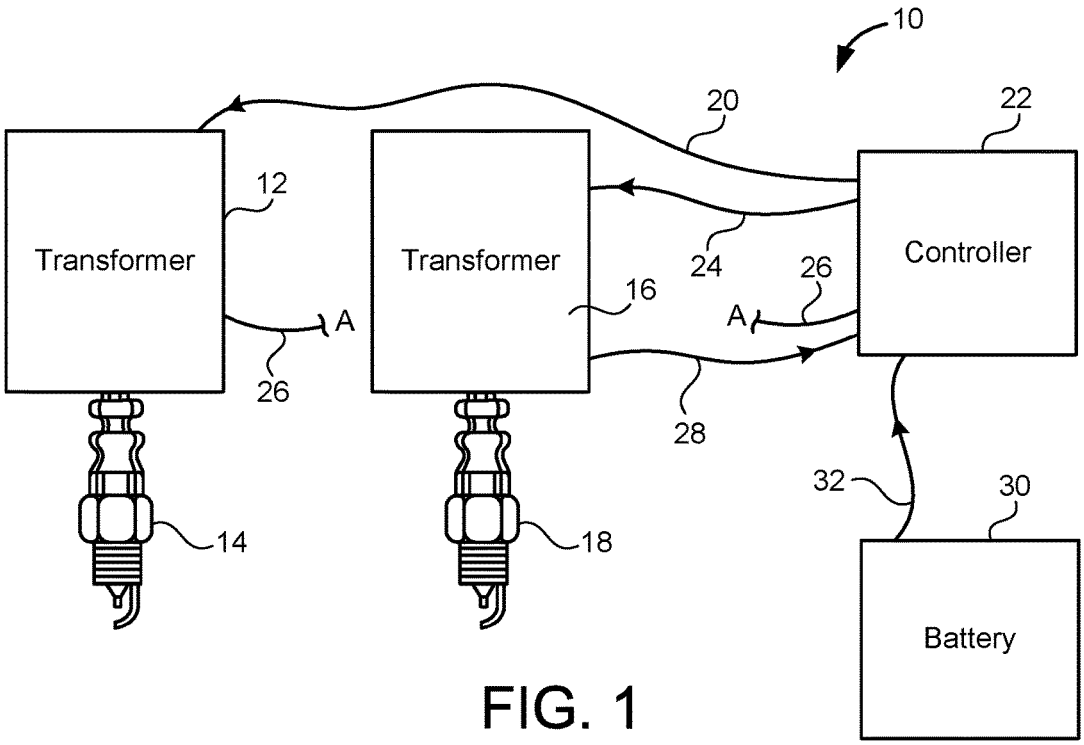
FIG. 1 is a diagrammatic illustration of the ignition system of the present invention.

Referring to FIG. 1, there is shown the ignition system 10 of the present invention. In particular, in FIG. 1, there is a transformer 12 that is directly connected to the spark plug 14. Similarly, a transformer 16 is directly connected to the spark plug 18. An electrical line 20 will extend from the engine control module 22 to the transformer 12. Another line 24 will extend from the engine control module 22 to the transformer 16. As such, the engine control module 22 (including the electronic spark timing circuit) can provide the necessary timing signals to the transformers 12 and 16 for the firing of the spark plugs 14 and 18, respectively. Each of the transformers 12 and 16 can be an ignition coil.

The transformer 12 can include a sensor line 26 extending back to the engine control module 22. As such, the engine control module 22 can receive suitable signals from the transformers 12 and 16 as to the operating conditions of the spark plugs 14 and 18 for a proper monitoring of the output current and output voltage of the secondary winding. By providing this information, the engine control module 22 can be suitably programmed to optimize the firing of the spark plugs 14 and 18 in relation to items such as engine temperature and fuel consumption. The transformer 16 also includes a sensor line 28 extending back to the engine control module 22. An automotive battery 30 is connected by a line 32 so as to provide power to the engine control module 22. The battery 30 is configured so as to supply at least eight volts to the engine control module 22.

As can be seen in FIG. 1, the firing of each of the spark plugs 12 and 16 is carried out directly on the spark plugs. The engine control module 22 can be a microprocessor which is programmed with the necessary information for the optimization of the firing of each of the spark plugs. The engine control module 22 can receive inputs from the crankshaft or from the engine as to the specific time at which the firing of the combustion chamber of each of the spark plugs 14 and 18 is necessary. Since each of the transformers 12 and 16 is located directly on the spark plugs 14 and 18, respectively, and since they operate at low frequencies, radio interference within the automobile is effectively avoided. Suitable shielding can be applied each of the transformers 12 and 16 to further guard against any radio frequency interference.

Figure 2:
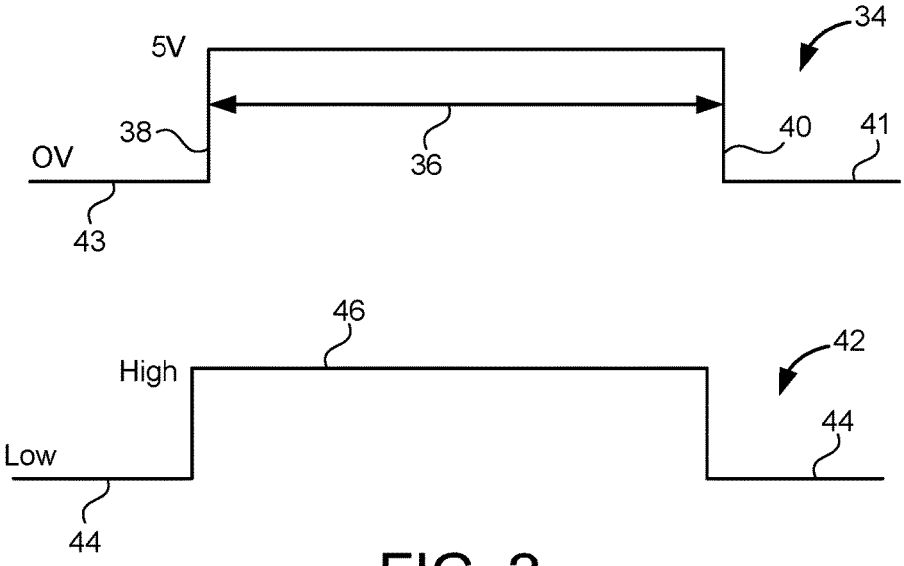
FIG. 2 shows a waveform associated with the firing of the spark plugs in relation to commands from the engine control module.

FIG. 2 illustrates graphically the manner in which the engine control module or the electronic spark timing circuit transmit signals so as to properly fire the transformers. In FIG. 2, the waveform 34 shows the power provided to one of the spark plugs 14 and 18 by way of the respective transformers 12 and 16. As can be seen, this is a square AC waveform that starts at 0 volts and rises to 5 volts. Arrow 36 illustrates the dwell time during the high-voltage portion of the waveform 34. The 0 volts goes to 5 volts along the rising edge 38 of the waveform. The high voltage goes back down to 0 volts along the falling edge 40 of the waveform 34. In order to fire one of the spark plugs 14 and 18, the voltage is applied during the falling edge or between the falling edge and the rising edge. This time is indicated by the lines having reference numerals lines 43 and 41. As such, the spark plug is activated during or after the falling edge 40 and the next rising edge 38. In the present invention, this area allows a series of short or long pulses, or a series of multi-strikes, or a series the multi-bursts to be applied.

The waveform 42 shows the pulse from the electronic spark timing circuit of the engine control module 22. This pulse has a logic low 44 and a logic high 46. When the pulse goes from the logic low 44 to logic high 46, this will correspond to the rising edge 38 of the waveform 34. The time that the signal is at logic high 46 will correspond to the dwell time 36 of the waveform 34. The change from logic high 46 to logic low 44 will correspond with the falling edge of the waveform 34. In this manner, the electronic spark timing circuit of the engine control module 22 will command the proper performance of the respective transformer or ignition coil.

Within the system of the present invention, the twelve volts input is nominally the voltage of the battery 30. This can vary from six volts at cranking to 14.5 or 15 volts during normal operation. The output voltage and energy of the high-voltage transformers is proportional to the input voltage. As such, it is necessary to provide enough voltage and energy input to start the vehicle during low voltage conditions, such as cold starting.

Figure 3:
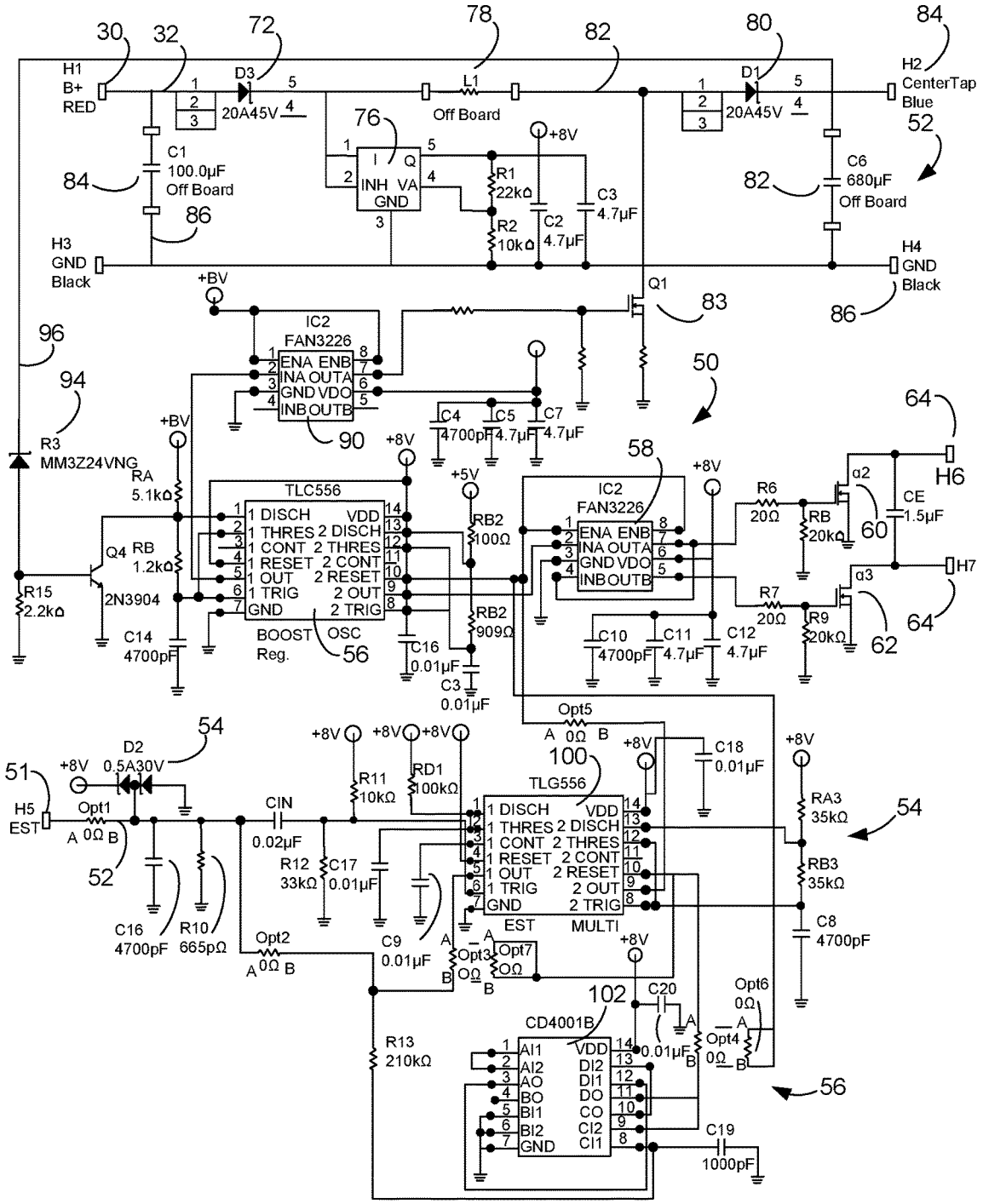
FIG. 3 is an electronic schematic of the electronic spark timing circuit, the booster circuit, the multi-strike circuit and the delay circuit of the ignition system of the present invention.

FIG. 3 is a schematic diagram showing they electronic control system 50, the power boost circuit 52, the multi-strike circuit 54 and the delay circuit 56 of the present invention. Initially, the electronic spark timing pulse is received at terminal 51. The spark timing pulse is transmitted along line 52. A blocking diode combination 54 is provided so as to block current from returning back along line 52 to the electronic spark timing pulse. Line 52 will extend to a boost oscillator timing IC 56. The boost oscillator timing IC 56 will provide for the isolation of the signal and the timing of the signal. For example, if it is desired to set the logic high of the waveform for one-hundred milliseconds, than the boost oscillator timer IC can be set for such period of time. As such, this will create the necessary timing for the electronic spark timing pulse. The boost oscillator timer IC ultimately create the waveform 42 which, in turn, will provide the necessary signal for the firing of the spark plugs in the manner shown by waveform 34. The boost oscillator timer IC is connected to the gate driver 58. Gate driver 58 is configured so as to alternately fire the field effect transistors 60 and 62. When the field effect transistors 60 and 62 are fired, then the timing pulse can be transmitted to the spark plug or to the transformer 64. Ultimately, is important that the gate driver 58 provide a fifty percent on/off duty cycle for each of the field effect transistors 60 and 62. As such, the field effect transistors 60 and 62 will never be on the same time. The field effect transistors 60 and 62 need to go on-and-off so as to avoid magnetic balancing issues on core saturation. This arrangement keeps the circuit sample, but effective. As will be described hereinafter, the power for the firing of the spark plugs is transmitted by the driver circuit by introducing the power to the field effect transistors 60 and 62.

In FIG. 3, a booster circuit 52 is provided so as to optimally store the power that is provided to the electronic spark timing circuit 60 so as to fire the respective spark plugs. The battery 30 is connected to the line 32 of the booster circuit 52. A diode 72 is provided on line 32 so as to prevent return current and voltage to the battery 30. The power from the battery 30 goes to a boost regulator so as to fix the voltage being transmitted to the inductor 78. Inductor 78 is a passive electronic component that stores energy in the form of a magnetic field. A diode 80 is provided on line 82 so as to block return current flowing to keep the charge on the capacitor 82. An input capacitor 84 is placed on line 86. Similarly, the output capacitor 84 serves to hold the charge as transmitted from the inductor 78. Ultimately, the output capacitor can be charged to twenty-eight volts. As a result, regardless of the firing of the respective spark plugs 14 and 18 by the electronic spark timing circuit 50 of the present invention, the capacitor 82 will continue to be charged during the process. As such, the battery is low, then the capacitor will continue to be charged. The lack of charge on the battery 30 will not change the waveform 34 in any way. All of the power for the firing of the spark plugs is a result of the charging of the capacitor 82. Fundamentally, if the engine speed is high, then the battery 30 will be fully charged. This will meet the requirements for producing the waveform 34. If the battery is low and the car is idling, the charge in the battery will be low. However, the power required for the firing of the spark plugs as a virtue of the waveform 34 will be less. Since the capacitor 82 is continuously charged by the boost circuit 52 of the present invention, the present invention avoids the need for any charging time for the ignition coils or the transformers. The power is continuously available.

A field effect transistor 83 is cooperative between the capacitor 82 and the inductor 78. As such, this will effectively control the charging of capacitor 82 from the energy stored in the inductor 78.

The output 84 of the booster circuit 52 will be connected to the center tab of field effect transistors 60 and 62 in the electronic spark timing circuit 50. Output 86 is connected to ground. Field effect transistor 83 serves to control the charge inductor and the timer control. The field effect transistor 88 operates in combination with the gate driver IC 90 and with a boost oscillator IC 56. The boost oscillator IC 56 sets the frequency of the signal passing as the output 84. This would be typically 50,000 Hz. However, the boost oscillator 56 could be set so as to change the firing pattern during the waveform. It can be used so as to create a multi-strike waveform or a multi-burst waveform, as will be described hereinafter. A Zener diode 94 is located on feedback loop 96 so as to set the target voltage for the circuit 70.

The electronic spark timing signal 51 is also transmitted along 52 to the multi-strike timer 100. Multi-strike timer 100 is a boost timer oscillator. This multi-strike oscillator 100 has a terminal connected to a terminal of the gate driver IC 58. As such, the multi-strike IC 100 can be controlled so as to set multiple strikes in a pulse from the electronic spark timing circuit. The multi-strike pulse can be fired continuously after the falling edge of the waveform. The multi-strike IC 100 can, in the preferred embodiment the present invention, set pulses of between 1 millisecond and 2 milliseconds. When multi-strikes are used during the firing of the spark plug, this can tend to create a more complete and cleaner combustion. Furthermore, it can also serve to reduce fuel requirements. The multi-strike oscillator 100 can create multiple strikes during the time period between the falling edge and the rising edge of the waveform. This period of time will be between ten milliseconds and fifty milliseconds. The oscillator in the multi-strike IC 100 transmits a signal to the gate driver 58 for action in conjunction with the field effect transistors 60 and 62.

The delay circuit 56 can be used in conjunction with the multi-strike circuit 54 and the electronic spark timing circuit 50. The delay circuit 56 has a timer delay IC 102 that is cooperative with the electronic spark timing signal 51. It can be seen that line 52 transmits the signal to the timer delay IC 102. Timer delay IC 102 is connected to a terminal of the multi-strike IC 100. In particular, the timer delay IC will be a NOR gate circuit. The NOR gate is a logic gate which gives a positive output only when both inputs are negative. YNAND gates, NOR gates or so-called "universal gates" that can be combined to form any other types of logic gate. As such, this NOR gate circuit can be used in connection with the electronic spark timing pulse so as to control and fix a delay of the pulse. For example, the timer delay IC 102 can be set so as to begin the spark-driving pulse at a time after the falling edge of the waveform. Alternatively, it can be set so as to create a delay between firing pulses during the period between the falling edge and the rising edge of the waveform. Various other configurations of delay can be implemented through the use of the delay circuit 56. Additionally, the delay circuit can be combined with the multi-strike circuit 54 so as to create delay associated with the multi-strike firing of the spark plug.

Figure 4A:
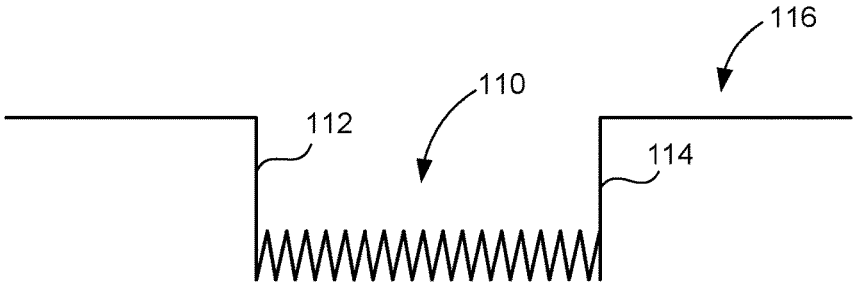
FIG. 4A-C show various waveforms associated with the ignition system of the present invention.
Figure 4B:
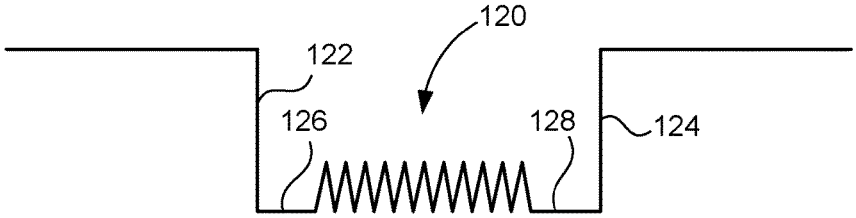
Figure 4C:
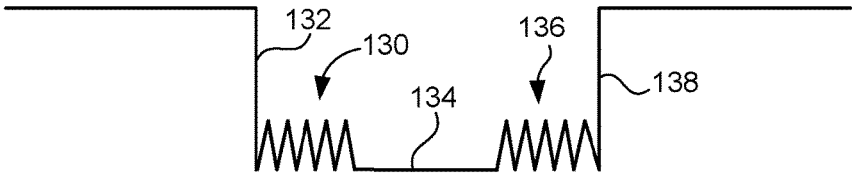

FIGS. 4A-4C show the various waveforms that can be created by the ignition system of the present invention. As can be seen in FIG. 4A, the ignition coil is being fired during the period 110 between the falling edge 112 and the rising edge 114 of the waveform 116. The firing pulse 110 is a multi-strike pulse. This multi-strike pulse is continuous between the falling edge 112 and the rising edge 114. In this configuration, the delay circuit 56 is not implemented. Typically, each of the pulses in the firing pulse 110 will be between one and two milliseconds. The entire firing pulse 110 will be between ten and fifty milliseconds.

FIG. 4B shows an alternative form that can be used for the firing of the spark plug. As can be seen, the firing pulse 120 occurs between the falling waveform 122 and the rising waveform 124. There is a first delay 126 between the falling waveform 122 and the firing pulse 120. There is another delay 128 between the firing pulse 120 and the rising waveform 124. Ultimately, the delay circuit 56 can be set so as to establish this type of firing pulse.

FIG. 4C shows still another form in which the delay circuit 56 can be combined with the multi-strike circuit 54 in order to create a unique waveform for the firing of the spark plug. It can be seen that there is a first firing pulse 130 that occurs at the falling waveform 132. A delay 134 occurs at the end of the firing pulse 130. Another firing pulse 136 will occur after the delay 134 until the rising waveform 138. The arrangement of waveforms 4A-4C can be adapted to the various configurations of coils. Ultimately, this can result in greater fuel efficiency, more power, cleaner combustion, and better cold starting.

The present invention generates an AC high-voltage spark output waveform. The spark event is of a predetermined spark duration based on engine conditions required to provide adequate energy to ignite the combustion mixture for a given cylinder condition. The present invention can be commanded to provide a given AC spark event of a predetermined duration based upon the AC system design elements. The AC ignition system can be configured to be directly controlled relative to the falling edge of the electronic spark timing pulse and be commanded to be delayed from such falling edge. In this manner, various electronic spark timing pulse-width commands can be employed to control the art duration of the spark plug directly.

The present invention provides an AC ignition system which allows for simple and direct control of the spark duration by use of the electronic spark timing signal directly and/or proportionately. The AC ignition control system provides a means for a series of short duration spark events which are timed from the falling edge of the electronic spark timing command pulse. The present invention further provides an AC control method which provides a means for a series of short duration spark events by direct control of the electronic spark timing pulse itself. The AC ignition system can be deployed via a serial data interface bus, or a similar strategy, which allows a similar precise digital control of the spark duration.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An ignition system for an internal combustion engine, the ignition system comprising:

a power source;

a transformer having a first primary winding and a second primary winding and a secondary winding, said first and second primary windings connected to said power source such that said transformer produces an alternating voltage output from said secondary winding of between 1 kHz and 100 kHz and the voltage of at least 20 kV;

a connector extending from said secondary winding, said connector adapted to connect with a terminal of a spark plug of the internal combustion engine;

electronic spark timing circuit cooperative with said transformer so as to activate deactivate voltage to said first and second primary windings, said electronic spark timing circuit producing a square wave of voltage in which the square wave has a rising edge and a falling edge, said electronic spark timing circuit firing said transformer at or subsequent to said falling edge and before said rising edge;

a multi-strike circuit cooperative with said electronic spark timing circuit so as to fire said transformer with multiple strikes between said falling edge and said rising edge;

a gate-driver IC cooperative with said electronic spark timing circuit so as to transmit voltage relative to a timing pulse of said electronic spark timing circuit;

a first field effect transistor connected to an output of said gate-driver IC, said first field effect transistor being switchable so as to transmit the alternating voltage to said first primary winding; and a second field effect transistor connected to an output of said gate-driver IC, said second field effect transistor being switchable so as to transmit the alternating voltage to said second primary winding.

2. The ignition system of claim 1, said multi-strike circuit having an oscillator which fires said transformer with multiple strikes in which each strike has a duration of between one and two milliseconds.

3. The ignition system of claim 1, said square wave ranging from zero volts to five volts on the rising edge and from five volts to zero volts on the falling edge.

4. The ignition system of claim 1, said gate-driver IC inverting voltage so as to cause said first field effect transistor and said second field effect transistor to bias alternately.

5. An ignition system for an internal combustion engine, the ignition system comprising:

a power source;

a transformer having a first primary winding and a second primary winding and a secondary winding, said first and second primary windings connected to said power source such that said transformer produces an alternating voltage output from said secondary winding of between 1 kHz and 100 kHz and the voltage of at least 20 kV;

a connector extending from said secondary winding, said connector adapted to connect with a terminal of a spark plug of the internal combustion engine;

electronic spark timing circuit cooperative with said transformer so as to activate deactivate voltage to said first and second primary windings, said electronic spark timing circuit producing a square wave of voltage in which the square wave has a rising edge and a falling edge, said electronic spark timing circuit firing said transformer at or subsequent to said falling edge and before said rising edge; and a multi-strike circuit cooperative with said electronic spark timing circuit so as to fire said transformer with multiple strikes between said falling edge and said rising edge, said square wave having a duration of between ten and fifteen milliseconds between said falling edge and said rising edge.

6. The ignition system of claim 1, further comprising:

a booster circuit cooperative with said electronic spark timing circuit so as to collect and store energy from said power source while said electronic spark timing circuit fires said transformer.

7. The ignition system of claim 6, said booster circuit having a capacitor connected to said power source, said capacitor storing and discharging energy of at least twenty volts.

8. An ignition system for an internal combustion engine, the ignition system comprising:

a power source;

a transformer having a first primary winding and a second primary winding and a secondary winding, said first and second primary windings connected to said power source such that said transformer produces an alternating voltage output from said secondary winding of between 1 kHz and 100 kHz and the voltage of at least 20 kV;

a connector extending from said secondary winding, said connector adapted to connect with a terminal of a spark plug of the internal combustion engine;

electronic spark timing circuit cooperative with said transformer so as to activate deactivate voltage to said first and second primary windings, said electronic spark timing circuit producing a square wave of voltage in which the square wave has a rising edge and a falling edge, said electronic spark timing circuit firing said transformer at or subsequent to said falling edge and before said rising edge; and a multi-strike circuit cooperative with said electronic spark timing circuit so as to fire said transformer with multiple strikes between said falling edge and said rising edge;

a delay circuit cooperative with said electronic spark timing circuit so as to fire said transformer at the time subsequent to the falling edge of the square wave and before the rising edge of the square wave, said delay circuit having a NOR gate logic circuit.

9. An ignition system for an internal combustion engine comprising:

a power source;

a transformer having a first primary winding and a second primary winding and a secondary winding, said first and second primary windings connected to said power source such that said transformer produces an alternating voltage output from said secondary winding of between 1 kHz and 100 kHz and voltage of at least 20 kV;

a connector extending from said secondary winding, said connector adapted to connect with a terminal of a spark plug of the internal combustion engine; and a delay circuit cooperative with said electronic spark timing circuit so as to fire said transformer at a time subsequent to the falling edge of the square wave and before the rising edge, said delay circuit having a NOR gate logic circuit.

10. The ignition system of claim 9, further comprising:

a booster circuit cooperative with said electronic spark timing circuit so as to collect and store energy from said power source while said electronic spark timing circuit fires said transformer.

11. The ignition system of claim 9, further comprising:

a multi-strike circuit cooperative with said electronic spark timing circuit so as to fire said transformer with multiple strikes between said falling edge and said rising edge.

* * * * *